US008932031B2

(12) United States Patent
Maguire et al.

(10) Patent No.: US 8,932,031 B2
(45) Date of Patent: Jan. 13, 2015

(54) MODULAR DIAPHRAGM PUMPING SYSTEM

(75) Inventors: Nathan D. Maguire, Costa Mesa, CA (US); Robert J. Romero, Anaheim, CA (US)

(73) Assignee: Xylem IP Holdings LLC, White Plains, NY (US)

( * ) Notice: Subject to any disclaimer, the term of this patent is extended or adjusted under 35 U.S.C. 154(b) by 513 days.

(21) Appl. No.: 13/097,889

(22) Filed: Apr. 29, 2011

(65) Prior Publication Data

US 2012/0107152 A1 May 3, 2012

Related U.S. Application Data

(60) Provisional application No. 61/409,629, filed on Nov. 3, 2010.

(51) Int. Cl.

| | |
|---|---|
| ***F04B 45/00*** | (2006.01) |
| ***F04B 43/06*** | (2006.01) |
| ***F04B 23/04*** | (2006.01) |
| ***F04B 41/06*** | (2006.01) |

(52) U.S. Cl.
CPC ..... *F04B 43/06* (2013.01)
USPC ..... 417/395; 417/521; 417/533

(58) Field of Classification Search
CPC ..... F04B 43/06; F04B 43/0026; F04B 49/00; F04B 17/00; F04B 43/026; F04B 5/00; F04B 33/005
USPC ..... 417/521, 533, 395
See application file for complete search history.

(56) References Cited

U.S. PATENT DOCUMENTS

| | | | | |
|---|---|---|---|---|
| 1,869,869 | A * | 8/1932 | Smith | 222/321.1 |
| 2,323,525 | A | 7/1943 | Ebel et al. | |
| 2,751,850 | A * | 6/1956 | Hoover | 417/536 |
| 2,965,088 | A | 12/1960 | Coffey | |
| 3,304,870 | A | 2/1967 | Growall et al. | |
| 3,424,091 | A | 1/1969 | Turner | |

(Continued)

FOREIGN PATENT DOCUMENTS

| | | |
|---|---|---|
| CN | 86208201 | 12/1987 |
| JP | 2000034981 | 2/2000 |

(Continued)

OTHER PUBLICATIONS

English language abstract of JP2007046529 (1 page), Feb. 22, 2007.

(Continued)

*Primary Examiner* — Devon Kramer
*Assistant Examiner* — Lilya Pekarskaya

(57) ABSTRACT

A pump system includes: a first coupler that receives a common input feed and provides two input feeds of fluid being drawn into the pump system, a second coupler that receives two output feeds and provides a common output feed of the pumped fluid, and a third coupler that receives a common gas feed providing two gas feeds to drive the pump system; two pumps, each having an inlet to receive a respective input feed, an outlet to provide a respective output feed of the pumped fluid, and a gas inlet to receive a respective gas feed so as to cause pumping action to drive the pump; and a base for holding the couplers with straps for attaching the two pump. The common gas feed causes pumping action in the two pumps and provides a constant almost pulsation free flow.

2 Claims, 3 Drawing Sheets

(56) References Cited

U.S. PATENT DOCUMENTS

| | | | | |
|---|---|---|---|---|
| 3,922,119 | A | 11/1975 | Rosenquist | |
| 4,168,288 | A | 9/1979 | Nau et al. | |
| 4,168,687 | A | 9/1979 | Kurahashi et al. | |
| 4,354,806 | A | 10/1982 | McMillin et al. | |
| 4,386,888 | A | 6/1983 | Verley | |
| 4,406,596 | A * | 9/1983 | Budde | 417/393 |
| 4,594,059 | A | 6/1986 | Becker | |
| 4,755,111 | A * | 7/1988 | Cocchi et al. | 417/394 |
| 4,778,356 | A * | 10/1988 | Hicks | 417/397 |
| 4,846,831 | A | 7/1989 | Skillin | |
| 4,895,494 | A | 1/1990 | Gardner | |
| 5,129,427 | A | 7/1992 | White et al. | |
| 5,167,837 | A | 12/1992 | Snodgrass et al. | |
| 5,174,731 | A | 12/1992 | Korver | |
| 5,261,798 | A | 11/1993 | Budde | |
| 5,263,827 | A | 11/1993 | Esposito et al. | |
| 5,332,372 | A | 7/1994 | Reynolds | |
| 5,334,003 | A | 8/1994 | Gardner et al. | |
| 5,667,368 | A | 9/1997 | Augustyn et al. | |
| 5,775,884 | A | 7/1998 | Westmoreland et al. | |
| 6,079,959 | A | 6/2000 | Kingsford et al. | |
| 6,152,705 | A | 11/2000 | Kennedy et al. | |
| 6,190,136 | B1 * | 2/2001 | Meloche et al. | 417/63 |
| 6,340,294 | B1 | 1/2002 | Kubota et al. | |
| 6,446,611 | B2 | 9/2002 | Ishikawa | |
| 6,588,383 | B2 | 7/2003 | Knaus et al. | |
| 6,644,941 | B1 * | 11/2003 | Able et al. | 417/393 |
| 6,764,287 | B2 | 7/2004 | Yamakawa | |
| 6,901,960 | B2 * | 6/2005 | Roberts et al. | 137/625.66 |
| 7,134,849 | B1 | 11/2006 | Steck et al. | |
| 7,311,503 | B2 | 12/2007 | Van Lintel et al. | |
| 7,322,803 | B2 | 1/2008 | Vogeley | |
| 7,497,670 | B2 | 3/2009 | Murata | |
| 2004/0057853 | A1 * | 3/2004 | Ross et al. | 417/426 |
| 2007/0253463 | A1 * | 11/2007 | Perry et al. | 374/208 |
| 2009/0010768 | A1 * | 1/2009 | Donovan | 417/53 |
| 2009/0053074 | A1 * | 2/2009 | Babicki et al. | 417/44.9 |

FOREIGN PATENT DOCUMENTS

| | | |
|---|---|---|
| JP | 2005076532 | 3/2005 |
| JP | 2007046529 | 2/2007 |
| WO | 2010099299 | 9/2010 |
| WO | 2010123965 | 10/2010 |

OTHER PUBLICATIONS

English language abstract of JP2005076532 (1 page), Mar. 24, 2005.
English language abstract of JP2000034981 (1 page), Feb. 2, 2000.
English language abstract of CN86208201 (1 page), Dec. 12, 1987.

* cited by examiner

MODULAR DIAPHRAGM PUMPING SYSTEM

CROSS-REFERENCE TO RELATED APPLICATIONS

This application claims benefit to provisional patent application Ser. No. 61/409,629, filed 3 Nov. 2010, which is hereby incorporated by reference in its entirety.

BACKGROUND OF THE INVENTION

1. Field of the Invention

The present invention relates to a pump system; and more particularly relates to a pumping system having modular diaphragm pumps.

2. Brief Description of Related Art

The current offerings in the marketplace known to the inventors in the prior art are positive displacement, single unit double diaphragm pumps which have one common shaft driving the diaphragms. The stroke is horizontal. These units are air operated and non-enclosed (meaning they have no cover over them). The common valving is ball check valves.

The following are some shortcomings of the current offering in the marketplace:

- Pulsation due to the double diaphragms being on a common shaft and larger volumes displaced,
- Excessive vibration transferred to mounting surface—caused by pump center of gravity (CG) and large displaced volume,
- These units are difficult to maintain, as they have many fasteners and are held together via common bolts,
- Limited valve options, and
- Pump failure leads to system shutdown until unit is repaired.

In view of this, there is a need in the marketplace for an improved pump or pumping system that overcomes these shortcomings.

SUMMARY OF THE INVENTION

According to some embodiments, the present invention provides new and unique apparatus in the form of a pump system, including a modular diaphragm pump system, comprising pump modules and couplers, where the pump modules are configured to receive input feeds of fluid being drawn into the pump modules, to provide output feeds of fluid being pumped from the pump modules, and to receive gas feeds to drive the pump modules; where the couplers are configured to receive a common input feed and to provide the input feeds of the fluid being drawn into the pump modules, to receive the output feeds and to provide a common output feed of the fluid being pumped from the pump modules; and to receive a common gas feed and to provide the gas feeds to drive the pump modules; and where the common gas feed causes the pump to provide a substantially constant almost pulsation free flow as one pump module becomes a master pump module and the other pump module becomes a slave pump module.

According to some embodiments, the present invention may also include one or more of the following features: Each pump module may have a respective inlet configured to receive a respective input feed to draw fluid into the pump modules. Each pump module may have a respective outlet configured to provide a respective output feed of the fluid being pumped from the pump modules. Each pump module may have a respective gas inlet configured to receive a respective gas feed to drive the pump modules. The couplers may comprise Y-couplers, each having one end with a single port, another end with two ports, and an intermediate part for branching the single port to the two ports, including where the Y-couplers include a fluid input Y-coupler having a common inlet configured to receive the common input feed of the fluid being drawn and having output ports configured to provide the input feeds to respective inlets of the pump modules, or where the Y-couplers include a fluid output Y-coupler having input ports configured to receive the output feeds from respective outlets of the pump modules and having a common output to provide the common output feed of the fluid being pumped from the pump modules, or where the Y-couplers include a gas inlet Y-coupler having a common gas inlet configured to receive the common gas feed and having output gas ports to provide the gas feeds to respective gas inlets of the pump modules. Each pump module may be configured with two diaphragms, a vertical stroke and a substantially low center of gravity.

The pump system according to some embodiments of the present invention has the following advantages that allow its design to overcome some of the problems of the current pumps being offered in the marketplace:

- Pulsation and vibration are minimized by the fact that the pump system or unit uses two modules, each using two diaphragms with a vertical stroke and a low center of gravity (CG),
- Ease of maintenance due to modular design, and the pump systems or units are held into place using a strap and handle technique or method,
- Modular design allows for increased flexibility in valving and materials handling,
- Easy to clean design,
- "Stackability" allows for manifolding the units to increase capacity,
- Modular design allows pumping system to continue working if one side of the design is failed, and
- Quick connects allows for easy assembly and installation.

BRIEF DESCRIPTION OF THE DRAWING

The drawing, which are not necessarily drawn to scale, includes the following Figures.

DETAILED DESCRIPTION OF THE INVENTION

Figure 1A:
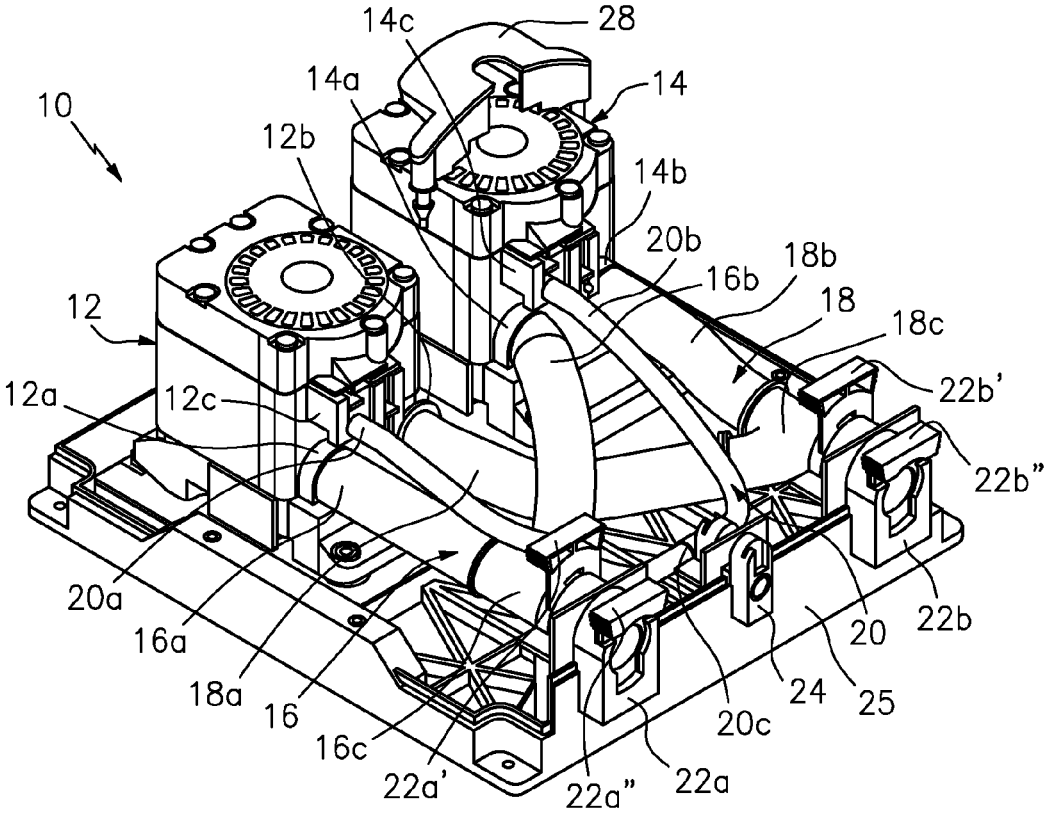
FIG. 1*a* is a top perspective view of a pump system according to some embodiments of the present invention.
Figure 1B:
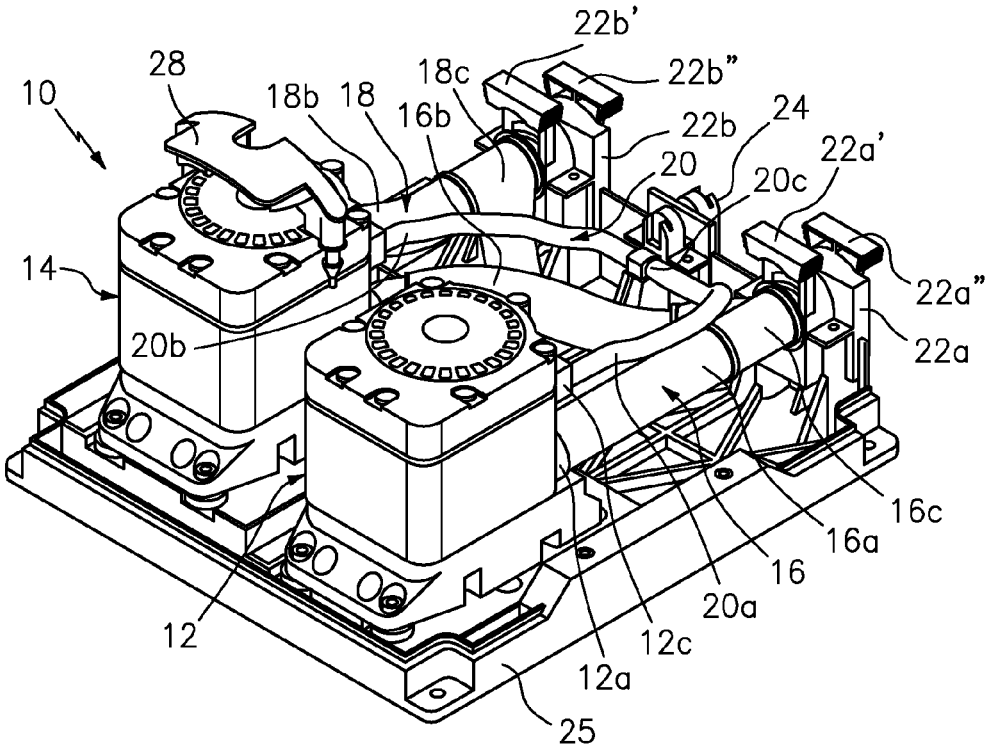
FIG. 1*b* is a top perspective view of the pump system in FIG. 1*a* rotated 90° counterclockwise, according to some embodiments of the present invention.
Figure 2A:
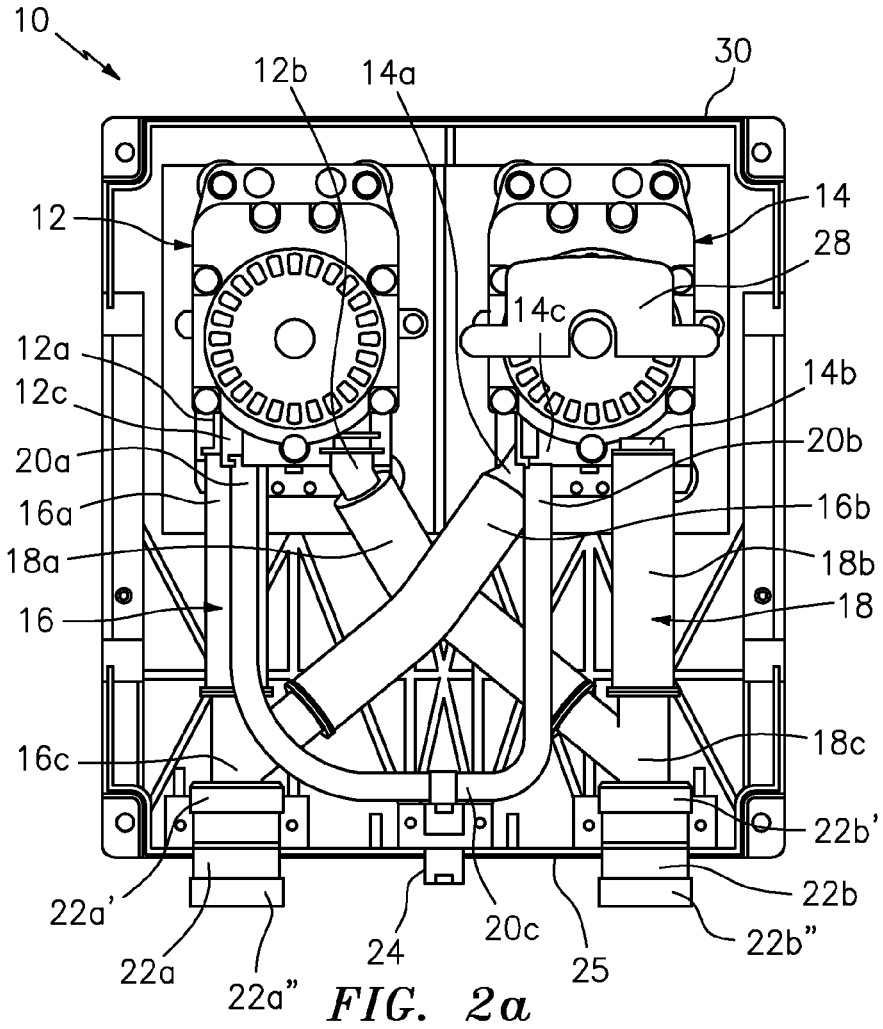
FIG. 2*a* is a top perspective view of the pump system shown in FIG. 1*a*, according to some embodiments of the present invention.
Figure 2B:
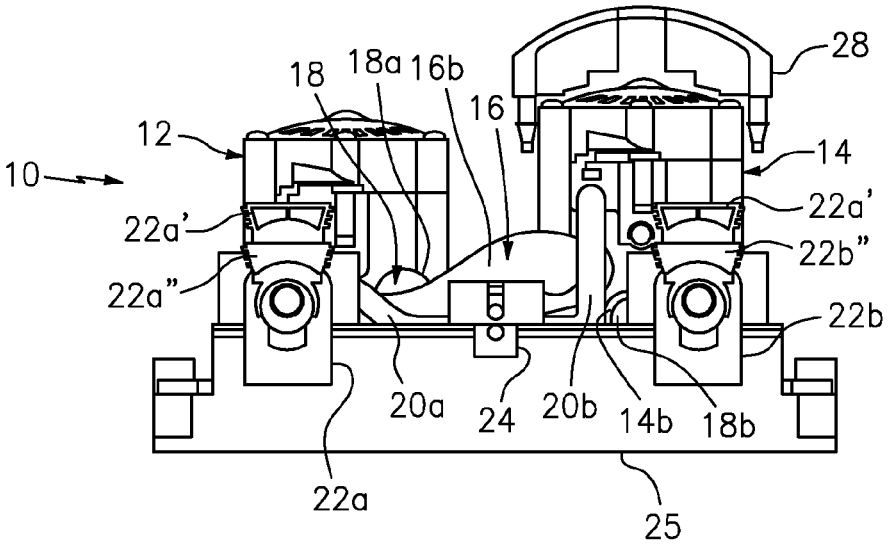
FIG. 2*b* is a side view of the pump system in FIG. 2*a* along view lines 2*b*-2*b*, according to some embodiments of the present invention.

FIGS. 1*a* to 3*b* show a new and unique pump system generally indicated by the arrow 10 that is shown by way of example as a modular diaphragm pump system. The pump system 10 includes two pump modules generally indicated by the arrows 12, 14 in combination with three Y couplers generally indicated by the arrows 16, 18, 20. Each Y coupler 16, 18, 20 has one end with a single port, another end with two ports, and an intermediate part for branching or coupling the single port to the two ports, consistent with that described below.

The pump modules 12, 14 are configured with respective inlets 12*a*, 14*a* to couple to respective input feed lines 16*a*, 16*b* of the Y coupler 16 to draw the fluid into the pump modules 12, 14. The pump modules 12, 14 may also be configured with respective outlets 12*b*, 14*b* to couple to respective output feed lines 18*a*, 18*b* of the Y coupler 18 to provide the fluid being pumped from the pump modules 12, 14. The pump modules 12, 14 may also be configured with respective gas inlets 12*c*, 14*c* to couple to respective gas feed lines 20*a*, 20*b* of the Y coupler 20 to receive the gas to drive the pump modules 12, 14. By way of example, each pump module 12, 14 may be configured with two diaphragms, each having a vertical stroke and a substantially low center of gravity, although the scope of the invention is intended to include other types or kinds of pumps either now known or later developed in the future.

The Y coupler 16 is configured with a common input feed line 16*c* to receive the fluid being drawn into the pump modules 12, 14 and to provide the fluid to the input feed lines 16*a*, 16*b*. The Y coupler 18 is configured with a common output feed line 18*c* to receive the fluid from the output feed lines 18*a*, 18*b* and to provide the fluid being pumped from the pump modules 12, 14. The Y coupler 20 is configured with a common gas feed line 20*c* to receive the gas to drive the pump modules 12, 14 and to provide the gas to the gas feed lines 20*a*, 20*b*. The common gas feed line 20*c* is coupled to a gas inlet 24 configured to receive a gas line (not shown).

In operation, the gas may take the form of air, which is fed into the pump or unit 10 via the air inlet. The air drives the diaphragm modules 12, 14 causing the pump action; and the fluid inlets 12*a*, 14*a* to the pump or unit 10 then draws the fluid into the pump system 10 and via one "Y" coupler is fed to both modules 12, 14. The fluid provided from the two modules outlets 12*b*, 14*b* are fed into another "Y" coupler then out through the discharge port or common output line 18*c*. Through a natural occurrence the air being feed to the air inlet 20*c* causes the pumps to work in such a fashion that they provide a constant almost pulsation free flow as one becomes the master and the other module the slave.

The pump system 10 may also include quick disconnects 22*a*, 22*b* having quick disconnect couplings 22*a*', 22*b*' for coupling to the Y couplers 16, 18 on one side and corresponding quick disconnect couplings 22*a*", 22*b*" for coupling to corresponding feed lines (not shown) on the other side.

In FIGS. 1*a*, 1*b*, 2*a* and 2*b*, the pump system 10 includes a base 26 for arranging and holding the components of the pumping system 10, including the pump modules 12, 14 three Y couplers 16, 18, etc. as shown, and also includes one or more straps 28 for holding or attaching one or more of the pump modules 12, 14 to the base 26.

Figure 3A:
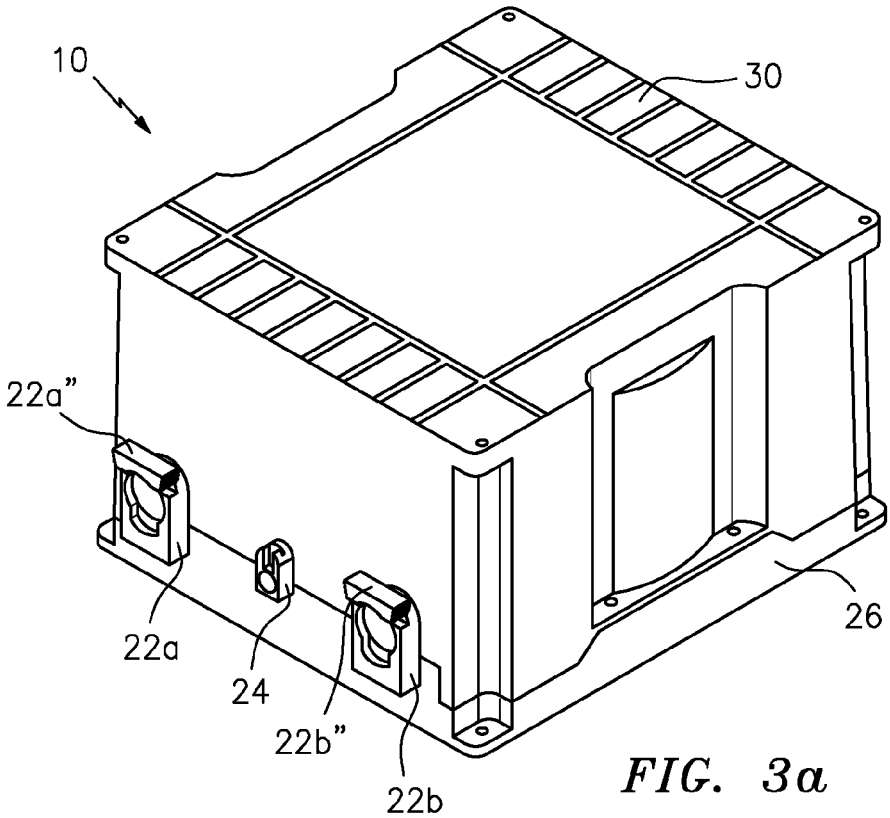
FIG. 3*a* is a top perspective view of the pump system in FIG. 1*a* with a cover arranged thereon, according to some embodiments of the present invention.
Figure 3B:
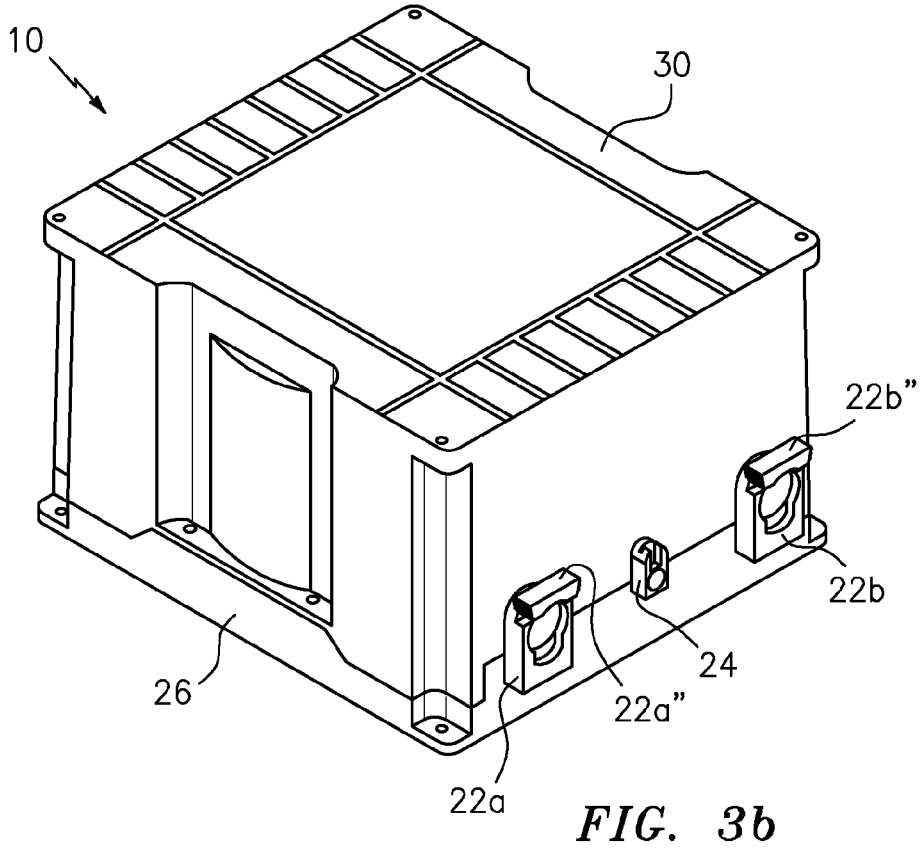
FIG. 3*b* is a top perspective view of the pump system in FIG. 3*a* rotated 90° counterclockwise, according to some embodiments of the present invention.

In FIGS. 3*a*, 3*b*, the pump system 10 has an optional cover 30 configured to couple to the base 26 and enclose the components of the pump system 10.

List Possible Applications

By way of example, possible applications of some embodiments of the present invention include fluid transfer and food handling.

The Scope of the Invention

Further still, the embodiments shown and described in detail herein are provided by way of example only; and the scope of the invention is not intended to be limited to the particular configurations, dimensionalities, and/or design details of these parts or elements included herein. In other words, a person skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What we claim is:

1. A pump system, comprising:

a first coupler configured to receive a common input feed and to provide two input feeds of fluid being drawn into the pump system;

a second coupler configured to receive two output feeds and to provide a common output feed of the fluid being pumped from the pump system;

a third coupler configured to receive a common gas feed and to provide two gas feeds to drive the pump system;

a pump configured with an inlet to receive one of the two input feeds of the fluid being drawn into the pumping system, with an outlet to provide one of the two output feeds of fluid being pumped from the pump system, and with a gas inlet to receive one of the two gas feeds so as to cause pumping action to drive the pump;

a corresponding pump configured with a corresponding inlet to receive a corresponding one of the two input feeds of the fluid being drawn into the pumping system, with a corresponding outlet to provide a corresponding one of the two output feeds of fluid being pumped from the pump system, and with a corresponding gas inlet to receive a corresponding one of the two gas feeds so as to cause pumping action to drive the corresponding pump;

a base configured for arranging and holding components of the pumping system, including the pump, the corresponding pump, the first coupler, the second coupler and the third coupler, and straps for holding or attaching the pump and the corresponding pump to the base;

the common gas feed causing corresponding pumping action in corresponding pumps so as to provide a constant almost pulsation free flow by the pump system;

wherein the pump and the corresponding pump are diaphragm pumps each being configured with a respective vertical pumping stroke in relation to the base and a low center of gravity.

2. A pump system according to claim 1, wherein the first coupler, the second coupler and the third coupler are Y-couplers, each having one end with a single port, another end with two ports, and an intermediate part for branching the single port to the two ports.

* * * * *